United States Patent [19]

Kato et al.

[11] 4,231,857

[45] Nov. 4, 1980

[54] PROCESS FOR PREPARING PETROLEUM-DERIVED BINDER PITCH

[75] Inventors: Osamu Kato, Yokohama; Seiichi Uemura; Syunichi Yamamoto, both of Kawasaki; Takao Hirose, Kamakura; Hiroaki Takashima, Kawasaki, all of Japan

[73] Assignee: Nippon Oil Co., Ltd., Tokyo, Japan

[21] Appl. No.: 55,052

[22] Filed: Jul. 5, 1979

[30] Foreign Application Priority Data

Jul. 14, 1978 [JP] Japan ..... 53-85044

[51] Int. Cl.[3] ..... C10C 1/00

[52] U.S. Cl. ..... 208/40; 208/22; 208/23; 208/131

[58] Field of Search ..... 208/23, 40, 131, 22

[56] References Cited

U.S. PATENT DOCUMENTS 3,350,295 10/1967 Hamner et al. ..... 208/40

*Primary Examiner*—Veronica O'Keefe

*Attorney, Agent, or Firm*—Jordan and Hamburg

[57] ABSTRACT

A process for the preparation of petroleum-derived binder pitch, comprising heat treating a mixture of both (1) a heavy fraction boiling at not lower than 200° C. and being obtained by the steam cracking of petroleum such as naphtha and (2) a heavy fraction boiling at not lower than 200° C. and being obtained by the catalytic cracking of petroleum such as gas oil.

8 Claims, No Drawings

PROCESS FOR PREPARING PETROLEUM-DERIVED BINDER PITCH

This invention relates to a process for preparing petroleum-derived binder pitch and more particularly to a process for preparing petroleum-derived pitch for use as an excellent binder in the manufacture of carbon articles. The object of this invention is to provide a process for preparing a petroleum-derived pitch for use as an excellent binder in the manufacture of carbon articles, particularly carbon electrodes which find application in the chemical and metallurgical industries such as the preparation of aluminum from $Al_2O_3$.

From the consideration of both environmental preservation and prevention of environmental pollution, the type of demand for petroleum-derived fuels has recently been changing to that for lighter petroleum fractions. For example, the conventional type of demand mainly for heavy fuel oil has been changing to the new type of demand mainly for gas oil or kerosene, and such a change or tendency would hereafter be increasingly accelerated. This tendency is clearly seen from the recent data on the kind and amount of crude oils imported into Japan, the data indicating that among all the imported crude oils, the proportion of amount of lighter crude oils from which lighter fractions will be obtained in a high yield is predominantly large.

However, in view of the problem of resources, there are very little possibilities that such lighter crude oils will hereafter be continuously imported. Thus, contrary to the present-time type of demand for the petroleum-derived fuels, it would be inevitable to import heavier crude oils.

To make a compromise between these conflicting factors (demand and supply), it will inevitably necessary to make light fractions from heavy fractions by using suitable processes. Super-heavy fractions partly produced by such suitable processes will raise serious problems as to their utilization and treatment to be solved in the future.

In relation with the demand for light fractions as fuels or with the availability of heavier crude oils as material for the fuels, varieties of petroleum fractions are intended to be used as starting materials for producing olefins. More particularly, in this country, naphtha now exclusively used as the starting material for producing olefins is intended, for the same purpose, to be at least partly substituted by crude oils or residual oils obtained at the time of reduced-pressure distillation, and in many plants such heavy fractions are being tried to be used for producing olefins therefrom.

However, the substitutive use of such heavy fractions as starting materials for producing olefins will result in a quantitative increase of heavy oils produced as by-products at the time of thermocracking the heavy fractions, and the development of technique of utilizing the heavy fractions will be a problem to be solved in the future.

One of uses of the heavy fractions as by-products is a starting material for producing a binder for carbon articles, and many efforts are continued in attempts to obtain binders of satisfactory quality from the heavy fractions as by-products.

On the other hand, binders which have been mainly used as such for carbon articles are coal tar pitch, while petroleum-derived binders are now hardly used except in special cases because of their unsatisfactory performances in spite of the efforts made by researchers in attempts to enable them to have satisfactory performances.

The present inventors made every effort in attempts to obtain excellent binders for carbon articles from petroleum-derived heavy fractions and, as a result, they have found a process for the preparation of excellent binders which eliminate the fundamental drawbacks of conventional petroleum-derived binders as mentioned hereinbelow.

It is said that binders for producing carbon articles, which will exhibit satisfactory practical performances as binders, should have a softening point, fixed carbon content, $\beta$-resin content, C/H ratio and true specific gravity in the respective ranges as shown in the following Table 1.

It is required that the binders have a softening point of not higher than 120° C. in view of their workability during the kneading and molding operations and they have a softening point of not lower than 70° C. in view of the strength of the resulting moldings or articles.

It is preferred that the binders have a high fixed carbon content which indicates the coking value of the binder alone since the binders when used in the manufacture of carbon articles such as carbon electrodes, will partly vanish as volatile matter by distillation and/or pyrolysis during the baking of the carbon articles to be obtained and will enable the remaining carbon to form bond carbon thereby to securely unite or bond with coke particles as the aggregate for the intended carbon articles thereby obtaining highly dense carbon articles.

The properties of the bond carbon so formed are conveniently associated with the C/H ratio indicating the aromaticity or with the true specific gravity having a close relation with the C/H ratio and, thus, the higher the aromaticity of the binder is, the higher bond strength the bond carbon formed thereof has.

Table 1

| Properties Required of Binders | |
|---|---|
| Properties | Range of numerical value for required property |
| Softening point (°C.) | 70–120 |
| Fixed carbon content (%) | At least 50 |
| $\beta$-resin content (%) | At least 15 |
| C/H ratio | At least 1.50 |
| True specific gravity (g/cm$^3$) | At least 1.30 |

On the other hand, L. F. King et al disclosed that after they had studied both the numerical values for the properties of various binders and the practical performances thereof (Fuel, 47, (3) 197–212 (1968)), petroleum-derived binders having approximately the same softening point and fixed carbon content as coal tar pitch are inferior to the coal tar pitch in the pressure resistance of baked electrodes prepared therefrom as indicated in Table 2.

Table 2

Properties and Performances of Various Binders

| Property and performance | Coal tar pitch | Petroleum-derived binder: Thermal tar heat treated pitch | Petroleum-derived binder: Catalytic cracking reduced pressure residual pitch |
|---|---|---|---|
| Property | | | |
| Softening point (°C.) | 92 | 92 | 95 |
| Specific gravity (15° C., g/cm$^3$) | 1.269 | 1.246 | 1.202 |
| Coking value | 53.5 | 53.7 | 52.0 |
| C/H ratio | 1.71 | 1.36 | 1.20 |
| $\beta$-resin content | 19.1 | 27.0 | 0.6 |
| Performance test | | | |
| Amount of binder | 32.5 | 28.0 | 28.0 |
| Specific gravity of baked electrode (g/cm$^3$) | 1.43 | 1.46 | 1.43 |
| Pressure resistance of baked electrode (Kg/cm$^2$) | 450 | 310 | 405 |

Table 2 further indicates that among the petroleum-derived binders, the thermal tar heat treated pitch which is higher in each of specific gravity, coking value, C/H ratio and $\beta$-resin content than the catalytic cracking reduced pressure residual pitch is inferior to the latter and that baked electrodes prepared using the heat treated pitch as the binder are inferior to those prepared using the residual pitch as the binder in the respect of practical performances such as specific gravity and pressure resistance. This fact shows that the heretofore known petroleum-derived binders are inferior in binder performances to the coal tar pitch now in use and that poor relations exist between the properties and binder performances of petroleum-derived binders prepared by treating (reforming) respective different starting materials in respective different manners, and, in other words, efforts to provide petroleum-derived binders with required properties will not necessarily be conducive to improvements in the binder carbonizability of the binders and the practical performances, such as the pressure resistance, of the resulting carbon articles in which the binders are used.

As mentioned before, the present inventors made various intensive studies in an attempt to eliminate the drawbacks of conventional petroleum-derived binders and, as the result of their studies, they succeeded in the production of petroleum-derived binder pitch exhibiting excellent practical binder performances as compared with the currently used coal tar pitch.

According to this invention, petroleum-derived binder pitch which is an excellent binder for producing carbon articles may be obtained by using a mixture of two different kinds of heavy fractions as the starting material and then heat treating the mixture.

This invention will be further detailed hereinbelow.

The starting oil which may be used in this invention consists essentially of a mixture of (1) a residual heavy oil having an initial boiling point of substantially not lower than 200° C., the residual heavy fraction (1) being obtained as a by-product at the time of steam cracking petroleum such as naphtha, kerosene or gas oil, at about 700°-1200° C. to produce olefins such as ethylene and propylene and (2) a heavy fraction having an initial boiling point of substantially not lower than 200° C., the heavy fraction (2) being obtained as a by-product at the time of catalytically cracking kerosene, gas oil or atmospheric pressure residual oil to produce light fractions such as gasoline.

This invention may be achieved by heat treating a mixture of the residual heavy fraction (1) and the heavy fraction (2), and, more particularly, the heat treatment is effected at 380°-500° C. for 15 minutes-20 hours.

It is known that the residual heavy fraction (1) or the heavy fraction (2) (also called decanted oil or clarified slurry oil) is heat treated alone to obtain pitch as a binder. For example, Japanese Patent Gazette No. 30073/68 discloses a process comprising heat treating a heavy fraction obtained as a by-product at the time of steam cracking gas oil for obtaining olefins therefrom, at 316°-438° C. for a time sufficient to remove (distil off) about 60-70 wt.% of the heavy fraction and then incorporating the remaining heavy fraction with a part of the distillate to adjust the softening point of the former. In addition, U.S. Pat. Nos. 2,992,181 and 3,140,248 disclose a process comprising heat treating a heavy fraction obtained as a by-product at the time of catalytically cracking gas oil, to obtain a petroleum-derived binder therefrom.

However, these known processes are intended to produce petroleum-derived binders which are improved in properties prescribed for evaluating the currently used coal tar pitch. The petroleum-derived binders so produced are inferior in practical binder performances to the currently used coal tar pitch binders and, thus, they are now not put to practical use except in certain areas where coal tar pitch is not easily available.

As mentioned before, the object of this invention is to provide a process for preparing petroleum-derived binder pitch having more excellent practical binder performances than the currently used coal tar pitch. As also mentioned before, the feature of this invention resides in a simple process comprising the use of the starting heavy fractions (1) and (2) in mixture, neither the fraction (1) nor (2) exhibiting satisfactory binder performances when used alone, thereby to obtain surprisingly high performance binders which when used as the binder will result in the production of carbon articles having excellent binder carbonizability, pressure resistance, specific gravity, electric properties and carbon dioxide gas oxidation resistance. This is quite unexpected from the conventional known techniques.

The residual heavy fraction (1) used as one of the components of the starting oil used in this invention, may be obtained by any usual known method. More particularly, the fraction (1) may be any heavy fraction having an initial boiling point of substantially at least 200° C. obtained as a by-product at the time of steam cracking petroleum such as naphtha, kerosene, gas oil, a crude oil or a straight-run residual oil, at 700°-1200° C. to obtain olefin therefrom. Such a heavy fraction (1) is satisfactory for use without being subjected to specific means such as pretreatment.

Even if the residual heavy fraction (1) contains a light fraction having an initial boiling point of lower than 200° C., it will not raise serious problems. However, in cases where the light fraction-containing heavy fraction is used for producing a binder therefrom, the existence of the light fraction will incur an increase in furnace capacity and heat treating tank capacity thereby incurring commercially undesirable expenses since the light fraction will only be distilled off without participating in a pitch-making reaction during the step of heat treatment.

The heavy fraction (2) which is the other of the components of the starting oil used in this invention, may be obtained as a by-product at the time of catalytically cracking petroleum such as kerosene, gas oil or an atmospheric pressure residual oil, to obtain gasoline therefrom. More specifically, the heavy fraction (2) may be one which boils at substantially at least 200° C., preferably at least 300° C., and is obtained as a by-product at the time of catalytically cracking kerosene, gas oil or an atmospheric pressure residual oil (this oil being obtained as the residual oil by the distillation of a crude oil at atmospheric pressure) at a temperature of 450°-550° C. and a pressure of from atmospheric to 20 $Kg/cm^2G$ in the presence of a natural or synthetic silica-alumina catalyst or zeolite catalyst in the form of fixed, moving or fluidized bed.

Starting oils to be catalytically cracked in this invention include not only said straight-run kerosene, gas oil and atmospheric pressure straight-run residual oil, but also kerosene and gas oil produced by thermocracking as well as kerosene and gas oil fractions hydrofined for desulphurization and the like. These starting oils may preferably be used in this invention.

There are considered cases where the heavy fraction (2) contains an unusually large amount of waxes depending on the kind of starting oil used for producing the fraction (2) and the operational conditions used therefor. Even such a fraction (2) may primarily be used in this invention.

However, if the fraction (2) contains an unusually large amount of straight-chain hydrocarbons such as waxes, then it will raise commercially undesirable problems as to, for example, an increase in furnace capacity. Thus, it is preferable that the amount of such straight-chain hydrocarbons contained in the fraction (2) be less than 50% thereof. If necessary, the straight-chain hydrocarbons may be removed by extraction with solvents, by decomposition by means of visbreaking or by other suitable methods.

In the practice of this invention, the starting petroleum fractions (1) and (2) may be mixed together in any ratios, however, they should be mixed together in the ratios by volume of 95-10:5-90, preferably 90-30:10-70, to obtain a binder having more excellent practical binder performances than the currently used coal tar pitch.

This invention may be accomplished by heat treating the mixture so obtained. The heat treating temperature may be in the range of 380°-500° C., preferably 410°-460° C.

The use of a low heat treating temperature (lower than 380° C.) will retard the proceeding of the reaction thereby requiring such a long heat treating time as to be unsuitable for use in commercial production, while the use of a high heat treating temperature (higher than 500° C.) will increase undesirable side reactions such as coking thereby making it impossible to attain the object of this invention.

As for the heat treating time used in this invention, it is necessary to use a long heat treating time when a low heat treating temperature is used, while it is necessary to use a short heat treating time when a high heat treating temperature is used. More specifically, the heat treating time may be in the range of from 15 minutes to 20 hours, preferably from 30 minutes to 10 hours. The use of an unduly short time will make it difficult to attain the object of this invention, while the use of an unduly long time will be disadvantageous in commercial production.

In the practice of this invention, any pressure may be used, however, preferable pressures should be such that the components of the starting oil (fractions (1) and (2) in mixture) are not substantially distilled off as they are unreacted to the outside of the system when heated to the predetermined heat treating temperature. More concretely, the preferable pressures may be in the range of 5-15 $Kg/cm^2G$.

As required after the end of the heat treatment, the unreacted heavy fraction or the light fraction produced at the time of the heat treatment may preferably be partly removed by distillation off or other suitable means.

In the practice of this invention, the reaction may be effected in any manner, for example, batchwise or continuously, and apparatuses for effecting the reaction may be of any type so long as they permit this invention to be practiced without hindrance.

One of the features of the binders obtainable by the process of this invention consists in their high binder carbonizability. As previously stated, in the production of carbon articles, coke which is aggregate for the carbon articles is kneaded with the binder to form a mixture which is then molded and baked at high temperatures. By the baking, the binder used is carbonized to form binder coke in order to unite the aggregate coke securely therewith. Thus, the higher the carbonizability of the binder (the binder carbonizability) is, the more preferable the binder is considered.

The coking value for the binder alone, for example the fixed carbon content thereof, has heretofore been used as an indicator of binder carbonizability.

The binders according to this invention are equal to, or less than, the heretofore used coal tar pitch in property so long as the property is expressed in terms of the coking value for the binder alone. However, in cases where the binder according to this invention is kneaded with coke (as aggregate), molded and then baked, it will exhibit a binder carbonizability of at least 80% which is a surprisingly high value. The reason for this is considered to be that the binder may have some specific capabilities such as affinity with the coke aggregate thereby exhibiting such high binder carbonizability. This would be the cause for unusually improving the mechanical performances and the like of carbon articles to be obtained by using the binder according to this invention in the resulting carbon articles.

The value "binder carbonizability" used herein is one which is measured by the use of the following method:

(i) $\omega_1$ g of pitch to be tested is kneaded with $\omega_2$ g of aggregate (petroleum coke) at a temperature of 50°-100° C. higher than the softening point of the pitch, to form a mixture, (ii) the mixture so formed is charged into a die (40 mm $\phi \times 40$ mm) and compression molded at the same temperature as said kneading temperature under the load of 2.5 ton for one minute to produce a test piece, (iii) the test piece so produced is charged into an electric furnace where it is baked under the following conditions:

Temperature-raising velocity:

200° C./day (room temp. to 600° C.)

600° C./day (600° to 1200° C.)

Time for which 1200° C. is maintained: 2 hours, (iv) the thus baked test piece is measured for its weight ($\omega_3$ g), and the binder carbonizability is calculated from the following formula $$\text{binder carbonizability (\%)} = \left(1 - \frac{\omega_1 + \omega_2 - \omega_3}{\omega_1}\right) \times 100$$

$$= \frac{\omega_3 - \omega_2}{\omega_1}) \times 100$$

It is not clear yet even to the present inventors why the binders obtained by the very simple process of this invention have such unexpectedly high binder performances as previously mentioned. The reason for such high binder performances is believed to be that the plural components in each of the fractions (1) and (2) act on each other during the heat treatment of these fractions thereby producing such excellent binders.

This invention will be better understood by the following non-limitative examples.

EXAMPLE 1

Ninety (90)% by volume of a heavy fraction with an initial boiling point of at least 192° C. (the heavy fraction being hereinafter referred to as "NHO") obtained by steam cracking naphtha at 830° C. was blended with 10% by volume of decanted oil (the oil being hereinafter referred to as "DCO") obtained by catalytically cracking in the presence of a silica-alumina catalyst an oil obtained by the hydrofining of a reduced-pressure gas oil (VGO) from Arabian crude oil, after which the resulting blend was heat treated at a temperature of 430° C. and a pressure of 10 Kg/cm$^2$G for 3 hours to obtain a heat treated oil. The heat treated oil so obtained was heated to 250° C. at 0.1 mmHg to distil off the light fraction to obtain pitch for use as a binder (that is, a binder pitch). The properties of the heavy fractions (NHO and DCO) used are shown in Tables 3 and 4. The properties of the binder pitch obtained are shown in Table 5.

EXAMPLES 2-4

The procedure of Example 1 was followed except the mixing ratio between the NHO and the DCO was varied, thereby to obtain pitch the properties of which are shown in Table 5.

COMPARATIVE EXAMPLES 1-2

The procedure of Example 1 was followed except that the NHO or the DCO as used in Example 1 was used alone to obtain binder pitch. The properties of the pitch so obtained are indicated in Table 5.

EXAMPLE 5

Electrode pieces were prepared using the binder pitch as obtained in Example 1. More particularly, calcined coke No. 2 was pulverized and separated into coarse particles (10 mesh or larger), medium particles (10–40 mesh), small particles (40–150 mesh) and fine particles (150 mesh or finer). A mixture containing, by weight, 19% of the coarse particles, 26% of the medium particles, 26% of small particles and 29% of fine particles was incorporated with the binder pitch as obtained in Example 1 to form a mixture which was kneaded under heat and then molded to obtain a green electrode piece having a size of 50 mm $\phi \times 10$ mm. The green electrode piece so obtained was buried in breeze and then baked at a temperature-raising velocity of 10° C./hr to 1200° C. to obtain an electrode piece. The thus obtained electrode piece was used as the carbon electrode for refining aluminum to make a test for its properties as the binder. The results are shown in Table 6.

EXAMPLES 6-8

The procedure of Example 5 was followed except that the binder pitch as obtained in each of Examples 2-4 was used, with the results being shown in Table 6.

COMPARATIVE EXAMPLES 3-4

The procedure of Example 5 was followed except that the pitch as obtained in each of Comparative examples 1-2 was used, and the results are indicated in Table 6. From this Table it is seen that the electrode pieces as obtained in Comparative examples 3 and 4 are inferior in pressure resistance and binder carbonizability to those as obtained in the Examples.

COMPARATIVE EXAMPLE 5

The procedure of Example 5 was followed except that coal tar pitch was used as the binder. The results are shown in Table 6, from which it is seen that the electrode piece as obtained in this Comparative example is inferior in pressure resistance and binder carbonizability to those as obtained in the Examples.

Table 3

| Properties Of Heavy Fraction Obtained As By-Product By Steam Cracking Of Naphtha | | |
|---|---|---|
| Specific gravity (15° C./4° C.) | | 1.039 |
| Conradson carbon (%) | | 6.8 |
| Distillation analysis | Initial Boiling Point | 192 (°C.) |
| | 5% | 200 (") |
| | 10% | 206 (") |
| | 20% | 217 (") |
| | 30% | 227 (") |
| | 40% | 241 (") |
| | 50% | 263 (") |
| | 60% | 290 (") |
| | 70% | 360 (") |

Table 4

| Properties of Decanted Oil | | |
|---|---|---|
| Specific gravity (15° C./4° C.) | | 0.965 |
| Distillation analysis | Initial Boiling Point | 320 (°C.) |
| | 5% | 340 (") |
| | 10% | 353 (") |
| | 20% | 370 (") |
| | 30% | 385 (") |
| | 40% | 399 (") |
| | 50% | 415 (") |
| | 60% | 427 (") |
| | 70% | 445 (") |
| | 80% | 467 (") |
| | 90% | 512 (") |
| Viscosity at 50° C. (cSt) | | 18.21 |
| Pour point (°C.) | | 42.5 |
| Conradson carbon (%) | | 3.09 |

Table 4-continued

| | Properties of Decanted Oil | |
|---|---|---|
| Ring analysis | Sat. (%) | 40.5 |
| | Arom. (%) | 55.1 |
| | Resin (%) | 4.1 |

Table 5

| | Composition of Starting oil | | Yield of pitch (based on the weight of starting oil) | Properties of pitch | | |
|---|---|---|---|---|---|---|
| | NHO (%) | DCO (%) | (%) | Softening point (°C.) | Fixed carbon content (%) | Benzen-insoluble matter content (%) |
| Comparative example 1 | 100 | — | 36.5 | 114 | 61.6 | 33.7 |
| Example 1 | 90 | 10 | 38.5 | 95 | 56.4 | 31.6 |
| Example 2 | 70 | 30 | 38.7 | 77 | 54.0 | 21.6 |
| Example 3 | 50 | 50 | 49.1 | 75 | 53.6 | 21.2 |
| Example 4 | 30 | 70 | 46.9 | 80 | 53.0 | 19.6 |
| Comparative example 2 | — | 100 | 47.0 | 78 | 52.8 | 18.8 |

treated at a pressure of 20 Kg/cm$^2$ and a temperature of 470° C. for 20 minutes. The mixture (NHO and DCO) so heat treated was heated to 250° C. at a reduced pressure of 1 mm Hg to distil off the light fraction thereby obtaining 36% by weight of pitch having a softening point of 100° C., fixed carbon content of 58% and benzene-insoluble matter content of 35%.

The procedure of Example 5 was followed except that the thus obtained pitch as the binder, to obtain an electrode piece having a binder carbonizability of 83% and a pressure resistance of 380 Kg/cm$^2$.

As mentioned above, this invention is characterized by the combined use, as the starting oil, of (1) the heavy fraction boiling at not lower than 200° C., obtained as a by-product when steam cracking petroleum and (2) the heavy fraction boiling at not lower than 200° C., obtained as a by-product when catalytically cracking petroleum. Carbon articles prepared using the pitch according to this invention as the binder are excellent in pressure resistance and binder carbonizability as compared with those prepared using the binder obtained from the heavy fraction (1) or (2) alone or coal tar pitch. In addition, this invention makes it possible to make effective use of such heavy fractions obtained as by-products as above.

Table 6

| Pitch | | Example 5 Pitch as obtained in Example 1 | Example 6 Pitch as obtained in Example 2 | Example 7 Pitch as obtained in Example 3 | Example 8 Pitch as obtained in Example 4 | Comparative example 3 Pitch as obtained in Comparative example 1 | Comparative example 4 Pitch as obtained in Comparative example 2 | Comparative example 5 Coal tar pitch |
|---|---|---|---|---|---|---|---|---|
| Amount of pitch used per 100 parts by weight of coke (parts by weight) | | 18 | 17 | 17 | 17 | 18 | 17 | 19 |
| Amount of breeze attached (g/cm$^2$) | | 0.031 | 0.025 | 0.033 | 0.018 | 0.029 | 0.027 | 0.030 |
| Voluminal shrinkage (%) | | 1.77 | 1.76 | 1.78 | 1.76 | 1.82 | 1.73 | 1.85 |
| Properties of electrode piece | Bulk specific gravity (g/cm$^3$) | 1.51 | 1.50 | 1.50 | 1.51 | 1.47 | 1.49 | 1.50 |
| | Specific electric resistance ($\Omega \cdot cm \times 10^{-4}$) | 54.6 | 56.1 | 55.9 | 54.7 | 60.8 | 57.3 | 56.0 |
| | Pressure resistance (Kg/cm$^2$) | 350 | 360 | 355 | 340 | 270 | 280 | 307 |
| | Binder carbonizability (%) | 81 | 80 | 80 | 82 | 69 | 75 | 76 |

EXAMPLE 9

Fifty (50) parts by weight of each of NHO and DCO as obtained in Example 1 were charged into an autoclave where the NHO and the DCO in mixture were heat treated at a pressure of 5 Kg/cm$^2$ and a temperature of 400° C. for 7 hours. The mixture so heat treated was heated to 250° C. at a reduced pressure of 1 mm Hg to distil off the light fraction thereby obtaining 49.4% by weight of pitch having a softening point of 80° C., Conradson carbon content of 56% and benzene-insoluble matter content of 28%. Using the thus obtained pitch as the binder, a green electrode piece was prepared in the same manner as in Example 5. The green electrode piece so prepared was then baked at 1200° C. to obtain an electrode piece having a pressure resistance of 365 Kg/cm$^2$ and a binder carbonizability of 81%.

EXAMPLE 10

Eighty (80) parts by weight of NHO and 20 parts by weight of DCO, each obtained in Example 1, were heat

What is claimed is:

1. A process for the preparation of petroleum-derived binder pitch, comprising heat treating at 380°-500° C. for 15 minutes-20 hours a mixture of both (1) a heavy fraction boiling at not lower than 200° C. and being obtained by the steam cracking of petroleum and (2) a heavy fraction boiling at not lower than 200° C. and being obtained by the catalytic cracking of petroleum.

2. A process according to claim 1, wherein the mixture contains the heavy fractions (1) and (2) in the ratios by volume of from 95-10 to 5-90.

3. A process according to claim 1, wherein the heavy fraction (1) is obtained as a by-product at the time of steam cracking petroleum selected from the group consisting of naphtha, kerosene, gas oil, crude oils and straight-run residual oils, at 700°-1200° C. to obtain olefins therefrom.

4. A process according to claim 1, wherein the heavy fraction (2) is obtained as a by-product at the time of catalytically cracking petroleums selected from the group consisting of kerosene, gas oil and atmospheric pressure residual oils, in the presence of natural or synthetic silica-alumina catalyst at a temperature of from 450° to 550° C. and a pressure of from atmospheric to 20 $Kg/cm^2G$ to obtain gasoline from the petroleum.

5. A process according to claim 1, wherein the heavy fraction (1) is obtained as a by-product at the time of steam cracking petroleum selected from the group consisting of naphtha, kerosene, gas oil, crude oils and straight-run residual oils, at 700°-1200° C. to obtain olefins therefrom, and the heavy fraction (2) is obtained as a by-product at the time of catalytically cracking petroleum selected from the group consisting of kerosene, gas oil and atmospheric pressure residual oils, in the presence of natural or synthetic silica-alumina catalyst at a temperature of from 450° to 550° C. and a pressure of from atmospheric to 20 $Kg/cm^2G$ to obtain gasoline from the petroleum.

6. A process according to claim 2, wherein the heavy fraction (1) is obtained as a by-product at the time of steam cracking petroleum selected from the group consisting of naphtha, kerosene, gas oil, crude oils and straight-run residual oils, at 700°-1200° C. to obtain olefins therefrom.

7. A process according to claim 2, wherein the heavy fraction (2) is obtained as a by-product at the time of catalytically cracking petroleum selected from the group consisting of kerosene, gas oil and atmospheric pressure residual oils, in the presence of natural or synthetic silica-alumina catalyst at a temperature of from 450° to 550° C. and a pressure of from atmospheric to 20 $Kg/cm^2G$ to obtain gasoline from the petroleum.

8. A process according to claim 2, wherein the heavy fraction (1) is obtained as a by-product at the time of steam cracking petroleum selected from the group consisting of naphtha, kerosene, gas oil, crude oils and straight-run residual oils, at 700°-1200° C. to obtain olefins therefrom, and the heavy fraction (2) is obtained as a by-product at the time of catalytically cracking petroleum selected from the group consisting of kerosene gas oil and atmospheric pressure residual oils, in the presence of natural or synthetic silica-alumina catalyst at a temperature of from 450° to 550° C. and a pressure of from atmospheric to 20 $Kg/cm^2G$ to obtain gasoline from the petroleum.

* * * * *